US008959694B2

(12) United States Patent
Clarke

(10) Patent No.: US 8,959,694 B2
(45) Date of Patent: Feb. 24, 2015

(54) BRIDGE APPARATUS

(75) Inventor: Derek William Frank Clarke, Banchory (GB)

(73) Assignee: Ensco 392 Limited, Edinburgh (GB)

( * ) Notice: Subject to any disclaimer, the term of this patent is extended or adjusted under 35 U.S.C. 154(b) by 0 days.

(21) Appl. No.: 13/988,866

(22) PCT Filed: Nov. 23, 2011

(86) PCT No.: PCT/GB2011/052297

§ 371 (c)(1), (2), (4) Date: Jul. 16, 2013

(87) PCT Pub. No.: WO2012/069825

PCT Pub. Date: May 31, 2012

(65) Prior Publication Data

US 2013/0283550 A1 Oct. 31, 2013

(30) Foreign Application Priority Data

Nov. 23, 2010 (GB) ..... 1019837.2

(51) Int. Cl.
*B63B 27/14* (2006.01)
*B63B 27/30* (2006.01)
(Continued)

(52) U.S. Cl.
CPC ..... *B63B 27/14* (2013.01); *B63B 27/30* (2013.01); *E01D 15/06* (2013.01); *E01D 15/08* (2013.01);
(Continued)

(58) Field of Classification Search
CPC B63B 27/14; B63B 27/30; B63B 2017/0072; B63B 2027/141; E01D 15/06; E01D 15/08; E01D 15/24; E01D 15/124
USPC ..... 14/31–34, 69.5–71.7
See application file for complete search history.

(56) References Cited

U.S. PATENT DOCUMENTS 2,188,554 A * 1/1940 Marianno ..... 114/262
2,473,126 A * 6/1949 Alexander ..... 14/71.1
(Continued)

FOREIGN PATENT DOCUMENTS

FR 2384898 A1 10/1978
GB 1566794 A 5/1980
(Continued)

OTHER PUBLICATIONS

Schnedler, Marlon, "International Search Report" for PCT/GB2011/052297, as mailed Apr. 17, 2012, 4 pages.

*Primary Examiner* — Raymond W Addie
(74) *Attorney, Agent, or Firm* — Winstead PC

(57) ABSTRACT

A bridge apparatus to transfer persons between a moving structure such as a vessel and a second structure such as an offshore installation, for example, to span gaps between work boats and fixed offshore installations such as wind turbines. The bridge comprises a platform supported by a line, the platform being moveable in a vertical direction by movement, of the line, wherein the line extends in a vertical direction from the platform to a capstan, and from the capstan to a counterweight. Thus the inboard end of the bridge can remain in generally the same vertical position in relation to the support structure of the vessel, moving with the vessel in the water, and the outboard end of the bridge apparatus can remain in generally the same vertical position relative to the wind turbine, and the relative vertical movement between the wind turbine and the vessel is compensated by the movement of the bridge, while the stepping on and stepping off points on the bridge remain generally still in relation to the vessel and the wind turbine.

18 Claims, 5 Drawing Sheets

(51) Int. Cl.

| | |
|---|---|
| ***E01D 15/06*** | (2006.01) |
| ***E01D 15/08*** | (2006.01) |
| ***E01D 15/12*** | (2006.01) |
| ***E01D 15/24*** | (2006.01) |
| *B63B 17/00* | (2006.01) |

(52) U.S. Cl.

CPC ..... *E01D 15/124* (2013.01); *E01D 15/24* (2013.01); *B63B 2017/0072* (2013.01); *B63B 2027/141* (2013.01)

USPC ..... 14/71.3; 14/69.5; 114/230.17

(56) References Cited

U.S. PATENT DOCUMENTS

| | | | | | |
|---|---|---|---|---|---|
| 2,641,785 | A | * | 6/1953 | Pitts et al. | 14/71.1 |
| 2,963,178 | A | * | 12/1960 | Walker | 414/139.5 |
| 3,426,719 | A | * | 2/1969 | Mizell | 14/71.7 |
| 3,740,782 | A | * | 6/1973 | Newman | 14/42 |
| 3,846,860 | A | * | 11/1974 | Kummerman | 14/71.1 |
| 3,875,603 | A | * | 4/1975 | Mampaey | 14/71.3 |
| 4,003,473 | A | * | 1/1977 | Ryan | 14/71.7 |
| 4,162,551 | A | | 7/1979 | Serrano | |
| 4,333,196 | A | * | 6/1982 | Bougaran | 14/71.7 |
| 5,950,266 | A | * | 9/1999 | Streeter et al. | 14/69.5 |
| 6,418,582 | B1 | * | 7/2002 | Petit | 14/71.5 |
| 7,350,254 | B2 | * | 4/2008 | Boulton | 14/2.4 |
| 8,127,388 | B2 | * | 3/2012 | Watchorn et al. | 14/2.6 |
| 2013/0255012 | A1 | * | 10/2013 | Prins | 14/71.1 |

FOREIGN PATENT DOCUMENTS

| | | | |
|---|---|---|---|
| GB | 2045173 | A | 10/1980 |
| GB | 2167714 | A | 6/1986 |
| WO | WO-02/20343 | A1 | 3/2002 |
| WO | WO-2007/120039 | A1 | 10/2007 |
| WO | WO-2011/014114 | A1 | 2/2011 |

* cited by examiner

BRIDGE APPARATUS

This invention relates to a bridge apparatus to transfer persons between a moving structure such as a vessel and a second structure such as an offshore installation. Embodiments of the invention are particularly useful to span gaps between work boats and fixed offshore installations such as wind turbines.

In the assembly, maintenance or repair of offshore installations, such as offshore wind turbines or their supports, personnel are required to move onto the fixed installation from a floating vessel, which moves in response to the waves/tide or other conditions.

At present personnel step directly from the vessel to a vertical ladder on the installation. Whilst safety lines can be attached to personnel, it is not a particularly safe manoeuvre. Present offshore wind turbines are located relatively close to shore in areas of moderate wave conditions. In the near future however it is envisaged that wind farms will be located further from shore, where waves and tides are stronger.

According to a first aspect of the present invention there is provided a bridge apparatus comprising a platform apparatus supported, in part at least, by at least one line;

at least a portion of the platform apparatus being moveable in a vertical direction by movement, in part at least, of said at least one line;

wherein the at least one line extends from its first end connected, directly or indirectly, to the platform apparatus, in a vertical or partially vertical direction, to a capstan, and from the capstan to the at least one line's second end, provided with a counterweight.

Thus where in practice the platform apparatus is provided on a floating support structure such as a water craft or vessel, it can be configured to move vertically (e.g. pivoting around a horizontal axis on the vessel) in contra-response to the movement of the vessel in water and so reduce at least in the vertical plane, and can typically eliminate, the relative vertical movement between at least a part of the platform and an installation/work platform, such as an offshore wind turbine, which can be fixed to the sea bed. Thus the inboard end of the bridge apparatus can remain in generally the same vertical position in relation to the support structure of the vessel, moving with the vessel in the water, and the outboard end of the bridge apparatus can remain in generally the same vertical position relative to the second structure/installation of the wind turbine (but need not necessarily be secured to the wind turbine) and the relative vertical movement between the support structure and the second structure is compensated for by the movement of the bridge. Typically the outboard end that extends toward the installation remains relatively vertically stationary in relation to the stationary installation, whereas the inboard end that is connected to the support structure of the vessel moves with the vessel relative to the installation, but relative to the vessel it remains in generally the same relative vertical position. Therefore, relative vertical movement is accommodated by movement of the bridge in between the support structure and the installation, while the stepping on and stepping off points on the bridge remain generally still in relation to the vessel and the wind turbine.

Optionally the bridge apparatus can be pivotally connected to the vessel, and can be pivotally connected or otherwise engaged with the installation (e.g. the wind turbine). The bridge apparatus can typically pivot around more than one axis, typically two axes, for example, in vertical and horizontal planes.

The pivot axes can typically be at least capable of allowing pivotal movement of the bridge in the vertical plane, so that for example, with a bridge attached between the side of a rolling vessel and a stationary wind turbine, the bridge moves up and down in the vertical plane around a pivot axis that is horizontal and parallel to the bow-stern axis of the vessel as the vessel rolls from side to side relative to the stationary wind turbine.

Optionally the pivot axes can also typically be capable of allowing pivotal movement of the bridge in the horizontal plane, so that for example, with a bridge attached between the side of a vessel and a wind turbine, the bridge moves laterally from side to side in the horizontal plane around a pivot axis that is vertical, as the vessel pitches from bow to stern relative to the stationary wind turbine.

Optionally the movement of the bridge in such circumstances is typically a combination of movement around the vertical and horizontal axes of the connection.

The provision of a counterweight as described herein can reduce the range of stress provided on control systems or the like, and so can save energy in operating the bridge apparatus, and can require lighter and less powerful control systems.

Typically the counterweight is set to be slightly less than the weight of the platform, for example 70-95% of the platform weight, typically 80-95% of the platform weight, and typically around 90% of the platform weight.

The bridge motion is typically compensated against the dynamic motions of the vessel by monitoring and measuring the vessel accelerations. This can be done optionally by accelerometers, and typically accelerometers measuring accelerations in 3 axes. The acceleration data are optionally collated by a Motion Reference Unit (MRU). The MRU typically feeds the data to a programmable logic controller which is typically programmed to calculate the necessary capstan winch motor speed to match and accommodate the accelerations of the vessel. Thus, the bridge position (or at least the outboard end of the bridge) is kept in a relatively constant position relative to the fixed installation, irrespective of the motion of the vessel, which helps the operator to use the control system to safely guide the bridge onto the landing point on the fixed installation.

Once the bridge is landed on the landing point on the installation, the drivers for the active movement of the platform relative to the vessel are powered down (optionally switched off, but can be operated at lower power in some embodiments) and the bridge moves passively relative to the vessel to which it is attached. As the counterweight is set to around 85%-95%, e.g. 90% of the bridge mass, the bridge has a nose weight on the landing point of the installation of around 10% of its mass. As the active drives are now typically in bypass mode the bridge moves with the motion of the vessel, and the light nose weight of around 10% of the bridge mass keeps the bridge in position on the landing point on the installation, but typically the light nose weight is not sufficient to rigidly attach the bridge to the landing point with any significant force. If the vessel motion suddenly increases so that the bridge pulled away from the installation, and lifted off the landing point, when the nose of the bridge is subjected to a vertical acceleration, the system can typically alarm and can be set to withdraw the bridge safely and resume active mode.

The bridge apparatus may be provided on a stationary or moving installation such as a stationary or moving offshore wind turbine, pillar, support structure or the like for connection to a second structure. Normally either the installation or the second structure moves in use. Usually the bridge apparatus is provided on a vessel. Thus the invention also provides a vessel comprising the bridge apparatus as described herein. The vessel may be a SWATH type vessel, for example a 60 m SWATH supplied by Abeking & Rasmussen (Lemwerder, Germany) although other vessels may be used.

For brevity, reference is made hereinafter to the position of the bridge provided on a vessel for connection to an installation, but should be construed as also applicable for provision of the bridge apparatus on an installation for connection to a vessel or other moving structure.

Typically the platform apparatus extends outwards from the vessel. An angle is defined between the vessel and the bridge apparatus.

The platform apparatus is normally partially laterally rotatable in the horizontal plane, such that, starting at the position where the bridge apparatus extends outwards from the side of the vessel so that it is perpendicular to the bow-stern axis of the vessel (0°) it can move by at least 10°, typically at least 20°, optionally at least 30°, and in some embodiments more than 35° around a vertical axis. Normally such rotation is provided in both lateral directions.

Such movement of the platform apparatus allows the bridge apparatus to counteract rotation around a vertical axis, pitching around a horizontal axis and fore-aft movement of the vessel relative to the installation in order to reduce, and typically eliminate, relative movement between the bridge and the installation.

Typically the platform apparatus has an axis and is extendable along the axis, such that it may extend and retract in length. Thus in use on a vessel it may be extended towards or retracted away from the installation. Such embodiments allow the platform apparatus to be extended to contact the installation. Typically a telescopic mechanism is provided to allow the platform apparatus to extend and retract. Thus the bridge apparatus can use such movement to extend and retract the platform apparatus, and also to cope with unintended lateral movement of the vessel relative to the installation, caused by waves for example.

Thus in some embodiments the bridge apparatus can move through all three dimensions. For such embodiments, the platform apparatus has all degrees of freedom to enable it to maintain a safe access platform for all expected relative vessel motions.

Typically movement of the bridge apparatus in at least one, typically two, and optionally all three dimensions may be controlled by a motorised mechanism.

Typically the motorised mechanism to control the at least one line is a capstan mechanism. Typically the capstan is provided on a pedestal, typically a head of the pedestal. Typically the counterweight is provided behind and below the pedestal. This has the advantage that it keeps the structure light and reduces the loads on the capstan and capstan mechanism. The line can comprise a wire.

The capstan may be a large diameter capstan, i.e. having a diameter of at least 30 times the line diameter to reduce friction and extend the life of the wire. Typically it uses a closed loop hydraulic drive to apply the required amount of torque to support the platform apparatus.

Typically the motorised mechanism to rotate the bridge comprises a slew gear rotation (ring gear and pinion drive, optionally in the pedestal) Typically the motorised mechanism to control the extension of the telescopic platform apparatus comprises a section drive (twin rack and pinion).

Typically the bridge apparatus comprises an automated launching mechanism. Typically therefore the bridge apparatus comprises at least one, typically a combination of sensors. The sensors may include one or more of motion sensors, distance sensors, position sensors and visual sensors and are often provided on the far end of the platform apparatus. The sensors and launching mechanism are operable to maintain a position relative to a target on the installation. The sensors can combine optical and accelerometers to capture the relative motion.

A feedback loop may be incorporated and software used to triangulate the positions. Thus in use an operator can position the vessel next to the installation, and activate the automated launching system. The platform apparatus can then extend and move towards the installation, taking into account any relative movement between the vessel and the installation.

The installation may be provided with an easily detectable target for the sensors to detect, to facilitate the automatic launching mechanism.

The platform apparatus comprises a platform and typically also comprises a post and/or side barrier. Often the at least one line will be connected to the post and/or side barrier which is in turn connected to the platform.

Also normally the at least one line will extend in part, horizontally as well as vertically to the capstan, i.e. it typically extends diagonally. Normally there are two lines, typically on each side of the platform apparatus.

The platform apparatus normally extends for more than 5 m, typically more than 8 m and may extend for more than 10 m.

Typically the motorised mechanisms controlling the movement of the bridge apparatus are adapted to operate in an active mode, where movement extension/retraction of the bridge apparatus can be effected, and a passive mode, where the movement extension/retraction of the bridge apparatus largely, typically exclusively, reacts to the relative movement of the vessel and installation.

Thus once the platform apparatus is landed onto the turbine support, the motorised mechanisms are typically all put into a bypass mode whereby all motions react directly to the vessel motion and so typically no power is required.

Thus once docked in position, capstan and slew gear motors would go into bypass so the platform apparatus follows the motion of the vessel while maintaining contact with the installation. Typically the motorised mechanism for the platform apparatus also functions in bypass mode.

Thus in typical embodiments, the bridge apparatus is fully active when being deployed and recovered to facilitate accurate alignment to an installation, but once engaged, reverts to passive mode to respond automatically to the relative motion between the vessel and the installation. In the passive mode, no power may be required.

Thus according to a second aspect of the present invention there is provided a bridge apparatus comprising a platform apparatus, the platform apparatus moveable in at least one dimension, wherein the platform apparatus is moved by action of a motorised mechanism, the motorised mechanism being operable between an active mode when it is operable to move the platform apparatus, and a passive mode when the power is reduced to the movement mechanism and it reacts more to movement caused in use than when in the active mode.

According to the second aspect the invention also provides a vessel comprising the bridge apparatus of the second aspect of the invention.

The invention also provides a method of operating a bridge apparatus, the bridge apparatus comprising a platform apparatus, the platform apparatus being moveable in at least one dimension;

moving the platform apparatus to/from a first moving structure to a second structure, by action of a motorised mechanism in an active mode, thereby providing a platform between the first and second structures;

changing the movement mechanism to a passive mode by reducing the power to the movement mechanism such that the platform apparatus is more susceptible to movement caused by the movement of the first moving structure; compared to its susceptibility to such movement in the active mode.

Typically the first moving structure is a vessel.

Typically the bridge apparatus of the second aspect of the invention comprises the features of the bridge apparatus according to the first aspect of the invention, and all optional features of the bridge apparatus according to the first aspect of the invention are also optional features according to the second aspect of the invention, unless otherwise stated. For example, the movement of the bridge apparatus in all three dimensions, as described for the first aspect of the invention, is also an optional feature for embodiments according to the second aspect of the invention.

Thus the active mode is typically operated to move the platform apparatus in order to deploy and recover the platform apparatus and the passive mode is used when the platform apparatus is in place and stationary.

Thus an advantage of embodiments in accordance with the second aspect of the invention is that the bridge apparatus relies less on a computer controlled system to maintain connection between a vessel and an installation in use, and so such a robust software system to maintain contact is not required.

Typically the power to the motorised mechanisms is reduced by at least 50% in the passive mode compared to the active mode, typically at least 75%, more typically at least 90%. In typical embodiments, the motors controlling the movement in each direction are entirely passive and so the power to the motorised mechanisms is switched off.

Thus in passive mode, a main hydraulic unit is typically placed in a passive/standby mode. In this passive mode, a control system typically interrogates sensors and if they are within safe pre-determined parameters the control system will typically shut down the main power supplies. Typically even in passive mode a small make-up pump maintains a hydraulic system connected to the motorised mechanisms in a safe state to stop the likes of cavitation as the motorised mechanisms become pumps in effect. If the control system, which is typically monitoring at all times, detects any movement getting close to a pre-determined safety limit the main hydraulic power unit is typically powered up in readiness to make an automated detachment from the installation so as to prevent damage to either the bridge apparatus or the installation.

In some embodiments, the control system (and perhaps associated limit switches) monitoring typically the extreme range of movements for all three degrees of movement, along with associated controls providing alarms and ultimately the emergency raising and retraction of the bridge, uses hardware/analogue systems typically by mechanical/electrical limit switches and relays. Typically therefore no software is included in these features. An advantage of such embodiments is that costs are kept low while achieving very high inherent safety and reliability.

Typically an alarm system is provided which will sound should the bridge apparatus extend beyond its range of motion. A series of graduated alarms may be provided.

Thus according to a third aspect of the invention there is provided a bridge apparatus comprising a platform apparatus, the platform apparatus moveable in at least one dimension, the bridge apparatus having an alarm system adapted to trigger an alarm when the bridge apparatus is moved beyond a pre-determined position.

Embodiments of the third aspect of the invention are typically used with embodiments according to the first or second aspect of the invention. Typically the bridge apparatus of the third aspect of the invention comprises the features of the bridge apparatus according to the first and/or second aspect of the invention, and all optional features of the bridge apparatus according to the first and/or second aspect of the invention can be considered as optional features of the bridge apparatus according to the third aspect of the invention, unless otherwise stated.

Thus typical embodiments allow the bridge apparatus to move in all degrees of freedom to cope with all expected vessel motions. However should these be exceeded there may be a "traffic light" visual warning and/or audio warning system to alert the users. Ultimately the bridge apparatus is typically adapted to automatically break free to prevent damage to the installation.

The alarm may trigger activation of the motorised mechanisms on a stand by basis. Movement past further predetermined points may be adapted to cause more severe alarms or indeed automatic disengagement from the installation.

An embodiment of the present invention will now be described, by way of example only, and with reference to the accompanying figures in which.

Figure 1:
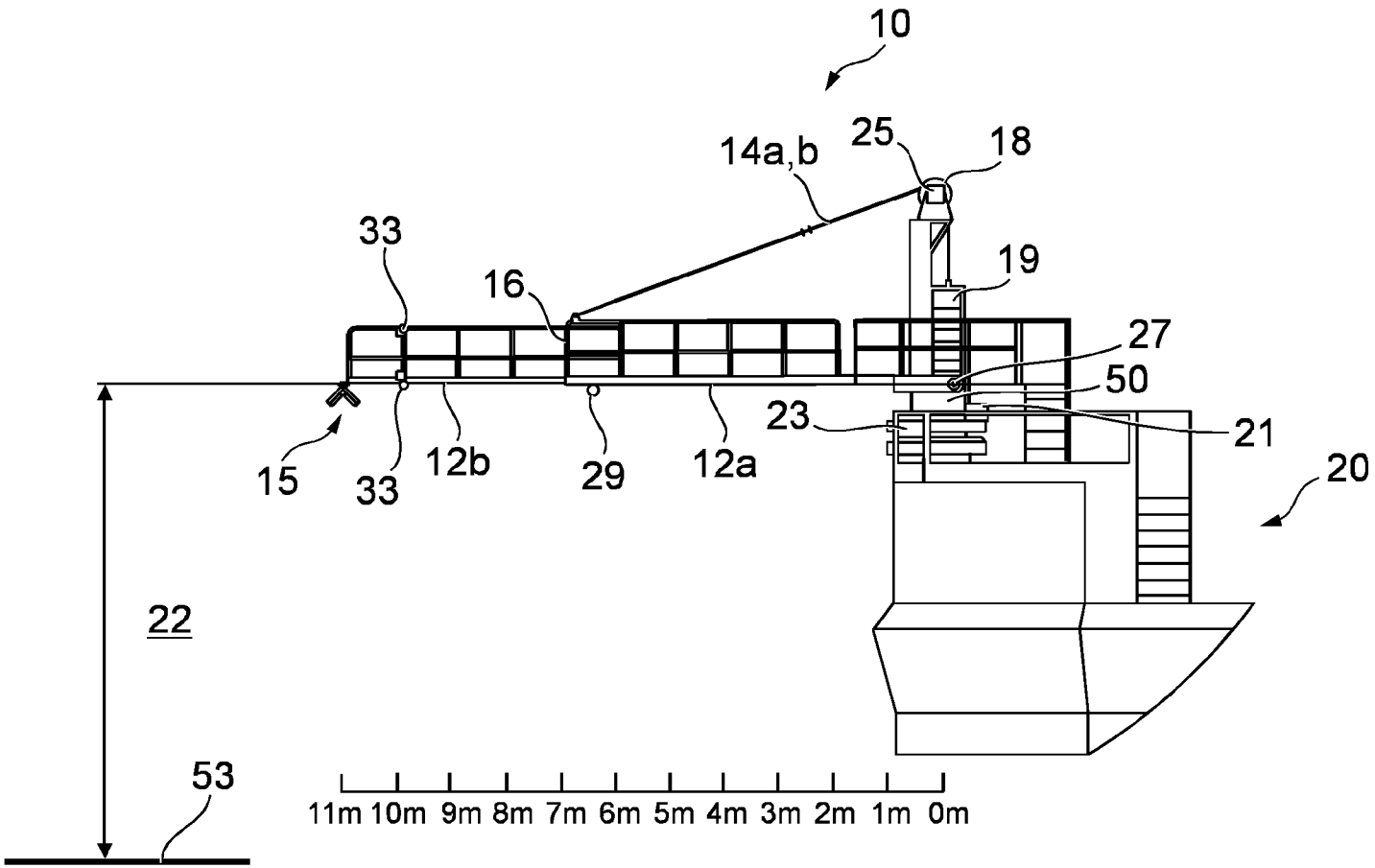
FIG. 1 is a side elevation of a bridge apparatus in accordance with the present invention mounted on a vessel.

FIG. 1 shows a side view of a bridge apparatus 10, connected to a vessel 20 and spanning a gap 22 above the sea 53 between the vessel 20 and a wind turbine support pillar (not shown in FIG. 1).

The bridge apparatus 10 comprises two platforms 12*a*, 12*b* telescopically connected to one another, and two lines (or backstays) 14*a*, 14*b* supporting the platforms 12*a*, 12*b* via side barriers 16. The wires 14*a*, 14*b* extend in a diagonal (partly vertical, partly horizontal) direction from the platform 12*a* to a capstan 18 and onwards to a counterweight 19.

Figure 2:
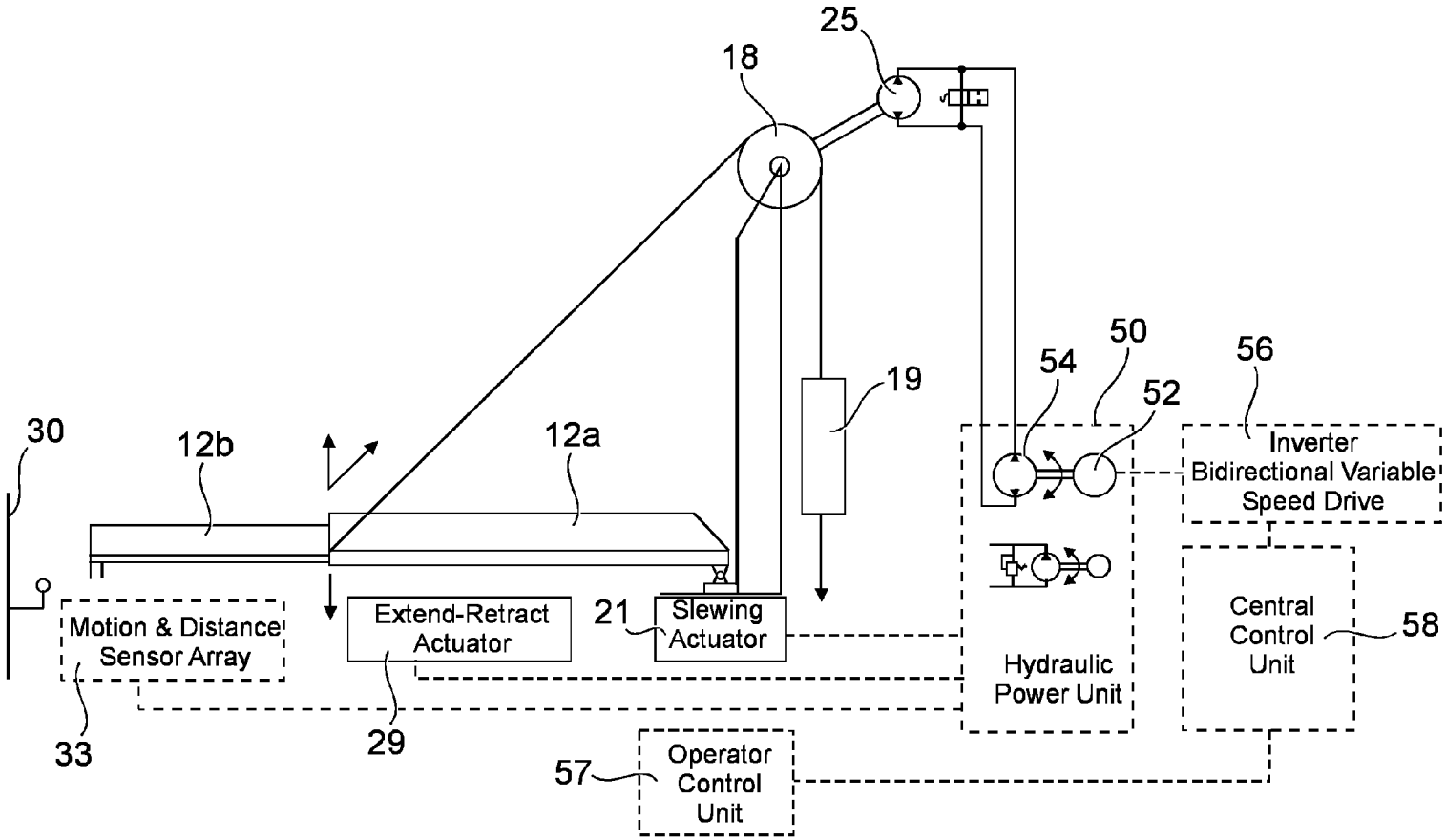
FIG. 2 is a side schematic elevation of the FIG. 1 bridge apparatus showing various motorised mechanisms.

As shown in FIG. 2, the bridge apparatus 10 comprises a plurality of motorised mechanisms: an actuator 29 controls telescopic extension and retraction of the platform 12*b* toward and away from the platform 12*a*; a slew mechanism with a slew drive 21 and ring gear 23 rotates the platforms 12*a*, 12*b* laterally around a vertical axis relative to a pedestal 13; and a capstan drive motor 25 drives the capstan 18 in order to pivot the platform 12*a* around a horizontal axis at pivot point 27. A hydraulic power unit 50 is provided which comprises an electric motor 52 and a bi-directional pump 54 which controls the capstan drive motor 25. Hydraulic power is also supplied to the slew drive 21 and extension/retraction actuator 29.

An invertor bi-directional speed drive 56 is connected to the hydraulic power unit 50. An operator control unit 57 is attached to this bi-directional speed drive 56 via a central control unit 58. Various sensors 33 are provided on the platform 12*b* so that the bridge apparatus 10 can automatically sense the platform's position during movement and can be directed to the desired position. The sensors 33 also receive hydraulic power from the hydraulic power unit 50.

To deploy the platforms 12*a*, 12*b*, the vessel 20 is maneuvered alongside the turbine support such that the bridge apparatus 10 is facing a landing point on the turbine support 30. The actuator 29 extends the platform 12*b* telescopically outwards from the platform 12*a* so that, after such extension, the platform 12*a*, 12*b* on the side of the vessel 10 extends towards the turbine support.

Figure 3:
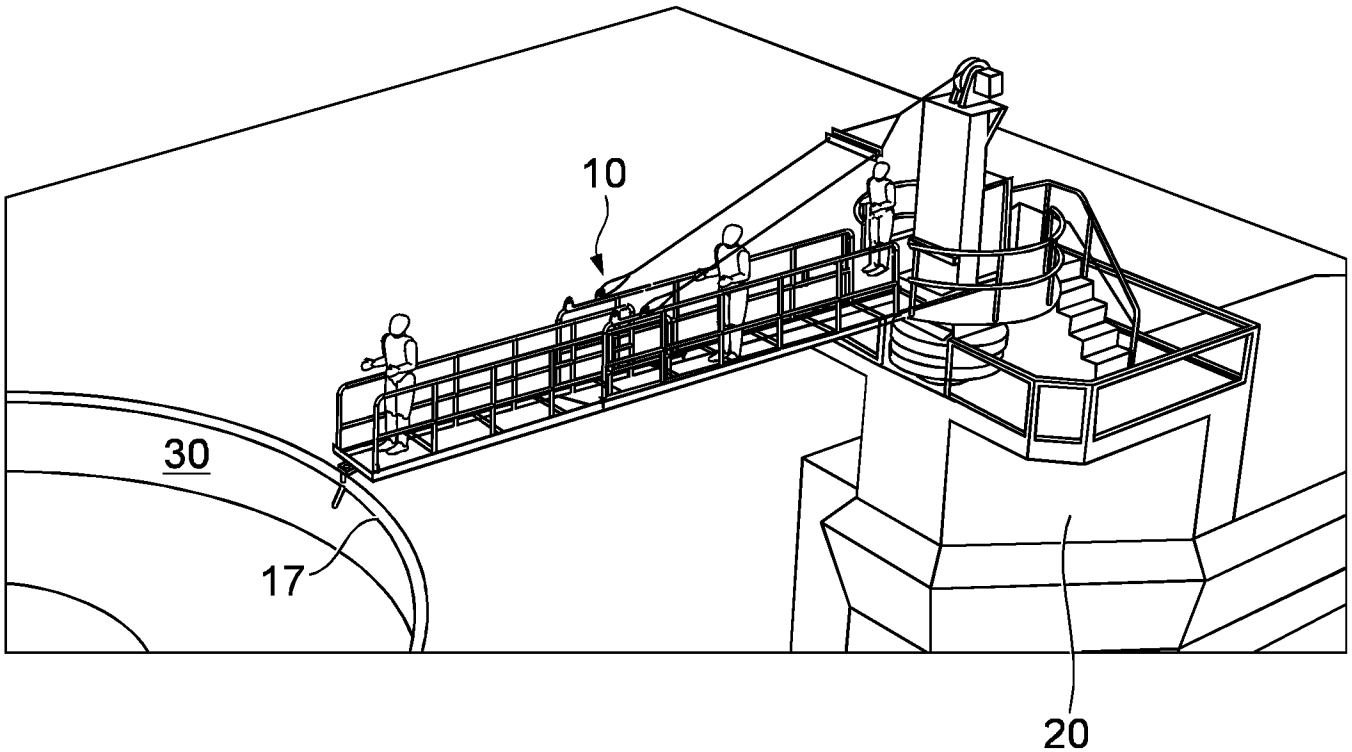
FIG. 3 is a perspective view of the bridge apparatus in use, located between a vessel and a turbine support.
Figure 4:
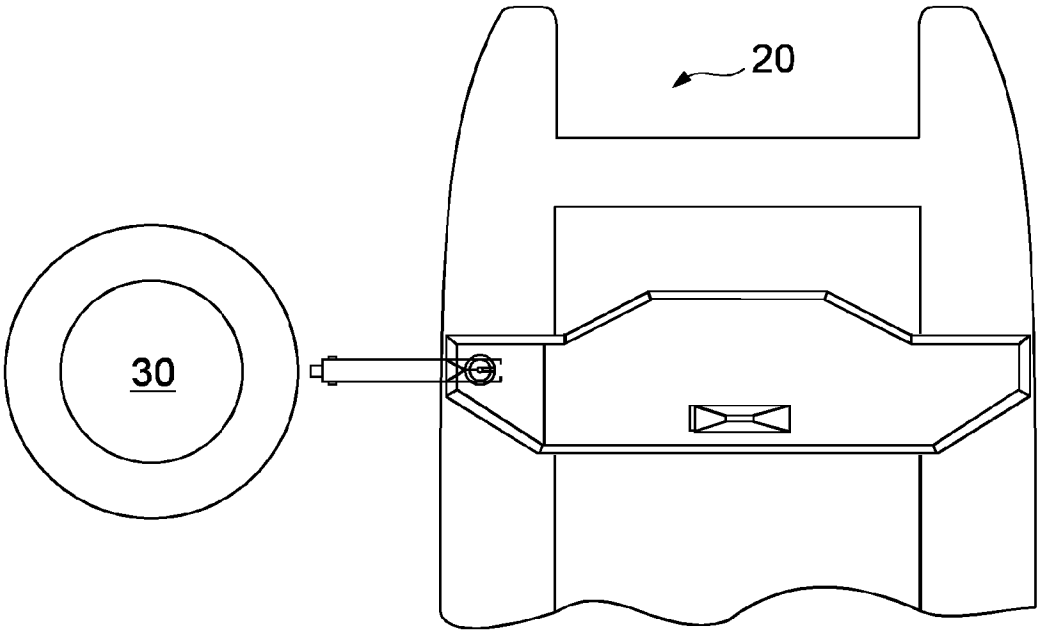
FIG. 4 is a top elevation of a bridge apparatus in accordance with the present invention along with a vessel and wind turbine support; and, FIG. 5 is an enlarged side elevation of the bridge apparatus in accordance with the present invention.

The bridge apparatus 10 thereby spans the gap 22 between the vessel 20 and the turbine support 30, as shown in FIG. 3. The platforms 12*a*, 12*b* may be rotated or pivoted by the slew mechanism 21, 23 and capstan 18 respectively in order to reach this landed position.

The telescopic platform 12*a*, 12*b* locks to the turbine support 30 by a rollered V-saddle 15 which sits on a 150 mm diameter top rail 17 which surrounds the entire turbine support 30. Such a rail 17 can be readily retro-fitted to existing turbine supports.

An automatic guidance mechanism comprises the sensors 33. Established position sensing and hydraulic control technology may be used for the guidance mechanism. These may include magnetic/proximity sensors, visual IR sensors, laser sensors, and/or solid state inertia accelerometers. Such sensors are commercially available from various companies, such as Siemens (Surrey, UK and international), Schneider, Omron and Emerson.

In alternative embodiments, this may be performed by manual control systems.

Thus the movement to span the gap 22 can be automatic once directed by a controller; the sensors 33 recognising a target position and software compensating for movement of the vessel in any direction.

In this landed position the various motorised mechanisms are then powered down and the platforms 12*a*, 12*b* allowed, within a certain range of motion described below, to pivot, rotate and extend/retract in response to the movement of the vessel relative to the turbine support 30. As the platforms 12*a*, 12*b* are adapted to move in response to the relative movement of the vessel 20 and turbine support 30, such embodiments of the present invention do not require complex software to align and maintain the platforms 12*a*, 12*b* in place. Rather the motors are powered down so the platforms 12*a*, 12*b* reacts and moves according to the movement of the vessel 20.

Figure 5:
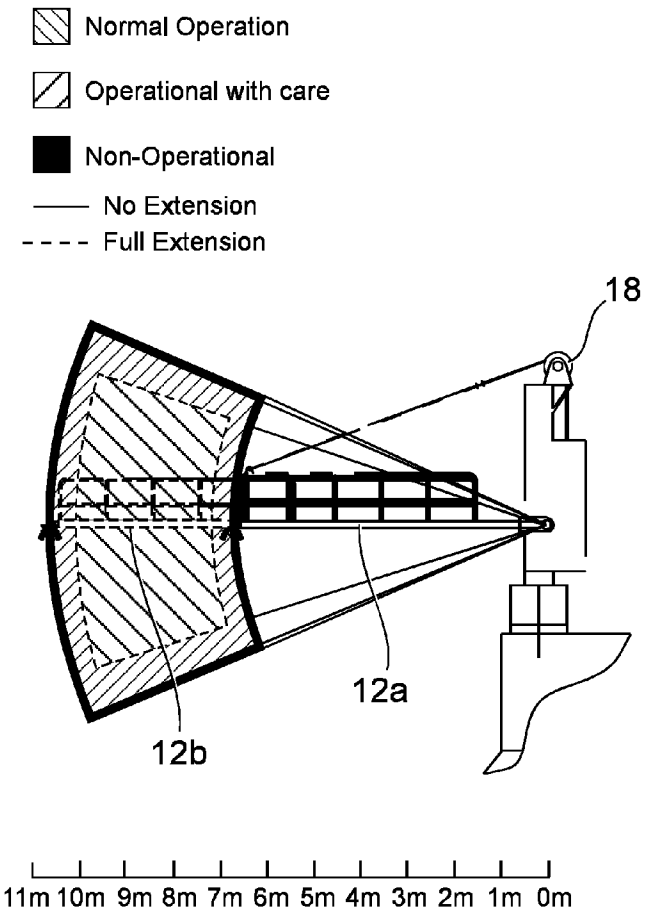

As shown in FIG. 5, the illustrated embodiment can pivot with a vertical angle of the bridge apparatus as 18° above and below the horizontal. Between 18 and 23° the bridge apparatus may be operated with care, whilst beyond 23° it will disengage from the turbine support 30 so to prevent damage to the bridge apparatus 10 or the turbine support 30.

In order to protect the bridge apparatus 10, the various motorised mechanisms (and associated hydraulic power system (not shown)) are adapted to power up when the platforms 12*a*, 12*b* reach a pre-determined angle in any dimension such as an angle of above 26.5° (or whatever angle is allowable for that particular embodiment) in order to be ready to be activated to disengage the platforms 12*a*, 12*b* from the turbine support where the angle caused by movement of the vessel is too large for the allowable range of motion for the platforms 12*a*, 12*b*.

Figure 6:
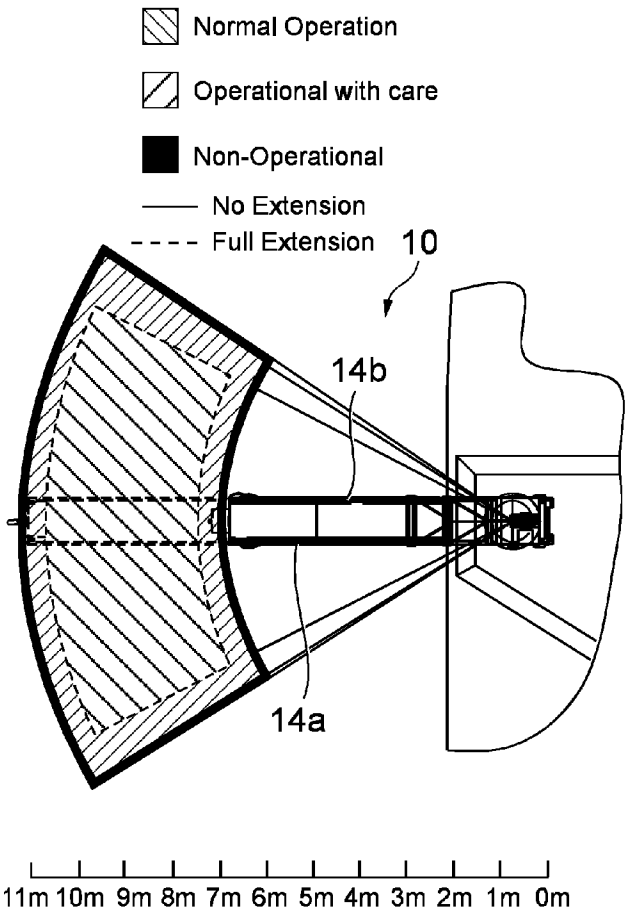
FIG. 6 is an enlarged top elevation of the bridge apparatus in accordance with the present invention.

FIG. 6 illustrates the rotation that the platforms 12*a*, 12*b* may undergo to gain access to the turbine support 30, and more importantly, in response to the movement of the vessel 20. In this embodiment, it may rotate by up to 27.25° in normal operation in either direction. Above 27.25° and less than 32.25° operation with care is permitted. At this point the capstan motor 25, slew drive 21 and actuator 29 will power up to be on stand-by should the platforms 12*a*, 12*b* require to be disengaged quickly if further limits are also exceeded. Beyond 32.25° the motorised mechanisms will engage to disconnect the platforms 12*a*, 12*b* from the turbine platform 30. For certain embodiments, proximity sensors (not shown) in the telescopic platform section and pedestal slew gear continuously monitor their positions and if either approach the predetermined limits an amber visual alarm is given to warn any users on the platforms 12*a*, 12*b* that the movement capacity is being reached. If the range of motions reaches a further predetermined limit indicative of a dangerous level then a red visual and audio alarm sound and the platforms 12*a*, 12*b* will be raised by the wires 14*a*, 14*b* and the telescopic platform 12*a*, 12*b* retracted to avoid damage to the platforms 12*a*, 12*b* or the turbine support 30.

Thus embodiments of the invention also provide the ability to directly access the turbine support without stepping across from a moving boat and climbing a ladder. Moreover certain embodiments allow such a transfer to take place in sea states of 3 mHs and higher.

Thus embodiments of the invention provide a motion compensated personnel access bridge apparatus to enable personnel to move directly from a support vessel to a tower work platform typically at 20 m above Lowest Astronomical Tide (LAT) in high sea states.

Thus embodiments of the invention benefit in that they provide a light weight, low power and inherently safe design.

Thus embodiments of the invention benefit in that the active phase is limited to the unmanned deployment and retrieval which reduces the criticality and cost of the software and componentry.

Embodiments of the invention benefit in that referencing is by local radar sensors which determine the relative position of the end of the telescopic platforms 12*a*, 12*b* section to a target ring integrated into the turbine support. In addition low cost accelerometers can also detect the absolute accelerations for back up and cross reference.

Thus embodiments of the invention benefit in that the platforms are counterbalanced by passing a support line around a capstan at the head of a support pedestal before going to a back tension counterweight. One benefit in counterbalancing the platforms is that it markedly reduces the power demand on a motion control system, which aside from reducing cost, weight, energy demand and wear, enables a very fast response control system which is largely immune from the vertical acceleration component as it acts equally on the bridge apparatus mass and counterweight. Due to the counterbalance, the required amount of torque to support the platforms is far lower and less variable which aids response and keeps the power very low. The counterbalance also ensures the landing weight of the bridge apparatus on the turbine support is at an acceptably low level. Embodiments of the invention can help to allow safer transfer of personnel from a vessel to an offshore turbine installation or other such offshore structure.

Improvements and modifications may be made without departing from the scope of the invention.

The invention claimed is:

1. A bridge apparatus mounted on a support structure and spanning between the support structure and a second structure, the bridge comprising a platform having an inboard end and an outboard end, wherein the inboard end of the platform is pivotally connected to the support structure, and wherein the outboard end of the platform is connected to the second structure, wherein the platform is supported by at least one line extending between the support structure and the platform, wherein the support structure has a capstan connected to the support structure and disposed above the platform, and wherein the at least one line extends from the platform to the capstan, and from the capstan to a counterweight, wherein at least a portion of the platform is moveable relative to the support structure in a vertical plane by movement of said at least one line, and wherein the capstan is motorised and pays out and recovers the line to raise and lower the platform toward and away from the second structure in a vertical plane around a pivot axis of the connection between the platform and the support structure.

2. The bridge apparatus as claimed in claim 1, wherein the bridge spans between the support structure at an inboard end of the platform and the second structure at an outboard end of the platform, wherein the inboard end of the platform is pivotally connected to the support structure, and wherein the line raises and lowers the platform toward and away from the second structure in a vertical plane around a pivot axis of the connection between the platform and the support structure.

3. The bridge apparatus as claimed in claim 1, wherein the counterweight balances less than a weight of the platform.

4. The bridge apparatus as claimed in claim 1, wherein the counterweight balances 90% of a weight of the platform.

5. The bridge apparatus as claimed in claim 1, wherein the bridge remains connected between the support structure and the second structure as the support structure and second structure move relative to one another during use of the bridge apparatus.

6. The bridge apparatus as claimed in claim 1, wherein an inboard end of the bridge apparatus is connected to the support structure and remains in generally the same vertical position in relation to the support structure, and wherein an outboard end of the bridge apparatus extends toward the second structure and remains in generally the same vertical position relative to the second structure, and wherein a relative vertical movement between the support structure and the second structure is compensated for by the movement of the bridge between the support structure and the second structure.

7. The bridge apparatus as claimed in claim 1, wherein the platform is pivotally connected to a vessel at a pivot connection, and can pivot around more than one axis of the pivot connection.

8. The bridge apparatus as claimed in claim 7, wherein the platform can pivot around vertical and horizontal pivot axes, allowing pivotal movement of the bridge in the horizontal and vertical planes around respective vertical and horizontal pivot axes.

9. The bridge apparatus as claimed in claim 1, wherein the capstan is provided on a pedestal, and wherein the counterweight is provided behind and below the pedestal.

10. The bridge apparatus as claimed in claim 1, comprising at least one sensor configured to sense a position of an outboard end of the platform and to maintain a position of the platform relative to a target on the second structure.

11. The bridge apparatus as claimed in claim 1, wherein the platform is connected between one moving and one fixed structure.

12. The bridge apparatus as claimed in claim 1, wherein the platform is connected to a water craft.

13. The bridge apparatus according to claim 1, wherein the movement of the platform is controlled by a control mechanism having an active mode in which force is applied to the platform to move the platform into a desired position in relation to the second structure, and a passive mode in which the platform is located in the desired position in relation to the second structure, wherein the force applied to the platform to move the platform in the passive mode is less than the force applied to the platform when the control mechanism is in the active mode.

14. The bridge apparatus as claimed in claim 13, wherein when the control system is in the passive mode, the movement of the platform is reactive to relative movement of the support structure and the second structure.

15. The bridge apparatus as claimed in claim 1, having an alarm system configured to sound an alarm when the movement of the platform extends beyond a defined parameter.

16. A bridge apparatus mounted on a support structure and configured to span a gap between the support structure and a second structure, the bridge apparatus comprising:

a platform supported by at least one line;

at least a portion of the platform being moveable in a vertical plane by movement of said at least one line; and wherein the at least one line extends from the platform to a capstan disposed above the platform, and from the capstan to a counterweight, wherein the counterweight balances less than a weight of the platform, wherein the platform has an axis and is extendable along the axis such that it may extend and retract in length, and wherein the capstan is motorised and pays out and recovers the at least one line to drive the movement of the platform in the vertical plane.

17. A method of operating bridge apparatus, the bridge apparatus comprising:

a platform supported by at least one line extending from the platform to a motorised mechanism disposed above the platform and from the motorised mechanism to a counterweight, the platform being moveable in a vertical plane;

wherein the platform comprises an axis and is extendable along the axis, such that the platform may extend and retract in length; the method comprising:

moving the platform in the vertical plane between a first structure and a second structure, by action of the motorised mechanism in an active mode, the first and second structures being movable relative to one another;

adjusting the length of the platform along the axis;

allowing the platform to move passively relative to the second structure to accommodate relative movement between the first and second structures; and wherein the motorised mechanism comprises a motorised capstan and wherein the method includes driving the movement of the platform in the active mode in the vertical plane by paying out and recovering the line with the motorised capstan.

18. A bridge apparatus mounted on a support structure and spanning between the support structure and a second structure, the bridge comprising:

a platform having an inboard end and an outboard end, wherein the inboard end of the platform is pivotally connected to the support structure, and wherein the outboard end of the platform is connected to the second structure, wherein the platform is supported by at least one line extending between the support structure and the platform, the platform being moveable in at least one dimension;

a capstan connected to the support structure and disposed above the platform, and wherein the at least one line extends from the platform to the capstan, and from the capstan to a counterweight, wherein the platform comprises an axis and is extendable along the axis such that the platform may extend and retract in length, wherein at least a portion of the platform is moveable relative to the support structure in a vertical plane by movement of said at least one line, and wherein the capstan is a motorised capstan and pays out and recovers the line to raise and lower the platform toward and away from the second structure in a vertical plane around a pivot axis of the connection between the platform and the support structure; and the motorised capstan being operable in an active mode when moving the platform, and in a passive mode when power is reduced to the motorised capstan and it reacts more to movement caused in use than when in the active mode.

* * * * *